US012050055B2

(12) United States Patent
Calderon et al.

(10) Patent No.: US 12,050,055 B2
(45) Date of Patent: Jul. 30, 2024

(54) LEAN GAS LNG HEAVIES REMOVAL PROCESS USING NGL

(71) Applicant: ConocoPhillips Company, Houston, TX (US)

(72) Inventors: Michael J. Calderon, Houston, TX (US); Will T. James, Houston, TX (US); Dale L. Embry, Houston, TX (US); Jinghua Chan, Houston, TX (US); Qi Ma, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 629 days.

(21) Appl. No.: 17/060,586

(22) Filed: Oct. 1, 2020

(65) Prior Publication Data

US 2021/0095918 A1 Apr. 1, 2021

Related U.S. Application Data

(60) Provisional application No. 62/908,953, filed on Oct. 1, 2019.

(51) Int. Cl.

| | |
|---|---|
| ***F25J 3/00*** | (2006.01) |
| ***F25J 1/00*** | (2006.01) |
| ***F25J 1/02*** | (2006.01) |
| ***F25J 3/02*** | (2006.01) |
| ***F25J 3/08*** | (2006.01) |

(52) U.S. Cl.

CPC ..... *F25J 1/0022* (2013.01); *F25J 1/02* (2013.01); *F25J 3/0233* (2013.01); *F25J 3/0238* (2013.01); *F25J 3/0247* (2013.01); *F25J 3/08* (2013.01); *F25J 2200/04* (2013.01); *F25J 2200/72* (2013.01); *F25J 2220/04* (2013.01)

(58) Field of Classification Search

CPC ..... F25J 3/0233; F25J 3/0209; F25J 3/0242; F25J 2205/50; F25J 2220/64; B01D 53/002; B01D 53/02

See application file for complete search history.

(56) References Cited

U.S. PATENT DOCUMENTS

| | | | | |
|---|---|---|---|---|
| 3,393,527 | A | 7/1968 | Swenson et al. | |
| 4,741,884 | A | 5/1988 | Carter et al. | |
| 6,463,758 | B1 * | 10/2002 | Le Bot | F25J 3/04175 62/654 |
| 9,869,510 | B2 | 1/2018 | Cuellar et al. | |
| 10,899,974 | B2 | 1/2021 | Davies et al. | |

(Continued)

FOREIGN PATENT DOCUMENTS

| | | | |
|---|---|---|---|
| EP | 0675190 | A2 | 10/1995 |
| WO | WO-2015138846 | A1 | 9/2015 |

OTHER PUBLICATIONS

International Search Report and Written Opinion for International Application No. PCT/US2020/053738 mailed Jan. 13, 2021, 9 pages.

(Continued)

*Primary Examiner* — Brian M King
(74) *Attorney, Agent, or Firm* — Polsinelli PC

(57) ABSTRACT

Disclosed herein are systems and processes for removing heavies during the liquefaction of a natural gas. The processes include dissolving the heavies in the natural gas by adding external natural gas liquid (NGL), followed by a staged removal of the natural gas liquid (NGL) and dissolved heavies.

21 Claims, 5 Drawing Sheets

(56) References Cited

U.S. PATENT DOCUMENTS

| | | | | |
|---|---|---|---|---|
| 11,662,141 | B2 | 5/2023 | Calderon et al. | |
| 2009/0090049 | A1* | 4/2009 | Chinn | F25J 1/0022 44/457 |
| 2009/0151391 | A1 | 6/2009 | Huang et al. | |
| 2011/0023563 | A1* | 2/2011 | Huang | E05B 35/007 70/31 |
| 2012/0096896 | A1 | 4/2012 | Patel et al. | |
| 2012/0227441 | A1* | 9/2012 | Mak | B01D 53/1475 62/617 |
| 2014/0260421 | A1 | 9/2014 | Lee et al. | |
| 2014/0305162 | A1* | 10/2014 | Callens | F25J 3/0276 62/617 |
| 2016/0245587 | A1* | 8/2016 | Shah | F25J 3/0238 |
| 2017/0036139 | A1 | 2/2017 | Lee | |
| 2017/0051970 | A1* | 2/2017 | Mak | F25J 3/0209 |
| 2018/0266757 | A1 | 9/2018 | Embry et al. | |
| 2020/0271381 | A1* | 8/2020 | Mudij | F25J 3/04412 |
| 2020/0370824 | A1* | 11/2020 | Mak | F25J 3/0238 |
| 2020/0386474 | A1 | 12/2020 | Chan et al. | |
| 2021/0253499 | A1* | 8/2021 | Bergmann | B01D 53/1475 |

OTHER PUBLICATIONS

Supplementary European Search Report for Application No. EP 20 87 1121 dated Oct. 13, 2023 (9 pages).

* cited by examiner

LEAN GAS LNG HEAVIES REMOVAL PROCESS USING NGL

CROSS-REFERENCE TO RELATED APPLICATIONS

This is a U.S. Non-Provisional Application claiming the benefit of U.S. Provisional Application 62/908,953, which was filed in the U.S. Patent and Trademark Office on Oct. 1, 2019, which is incorporated herein by reference in its entirety for all purposes.

BACKGROUND

I. Technical Field

The present disclosure relates generally to systems and methods for the liquefaction of a gas. More particularly, the present disclosure relates to a process of removing heavies during the liquefaction of natural gas.

II. State of the Art

Natural gas is an important resource that is widely used as an energy source or as an industrial feedstock. For example, it is used in the preparation of plastics and carbon tetrachloride. While natural gas is comprised primarily of methane, it can contain other $C_2$-$C_5$ hydrocarbons, such as ethane and propane, plus heavier hydrocarbons, such as hexanes, heptanes, decanes, dodecanes, and pentadecanes. These heavier hydrocarbons are commonly referred to as C6+ hydrocarbons, because they contain six or more carbons.

Although these heavier hydrocarbons are typically present at concentrations of less than 0.5 mol %, their presence can be problematic, because they can freeze within the devices used in a liquefaction process. If the heavy hydrocarbons freeze within a heat exchanger, such as a brazed-aluminum heat exchanger, or another part of the liquefaction process, an obstruction occurs and the liquefaction process will have to be shut down. After shutting down, the location of the obstruction, i.e., frozen hydrocarbons, must be located, followed by removal of the obstruction. Processes used to remove the frozen heavy hydrocarbons can include physical removal and melting of the frozen hydrocarbons.

Previous methods of removing hydrocarbon heavies from natural gas included utilizing large sorbent beds, but the sorbents must frequently be regenerated using a gas that is then discarded. Over time, this can become expensive and can negatively affect the operation of the liquefaction plant. Still other heavies removal processes have used a wash column, which includes a large flow of absorbent liquid to remove the hydrocarbon heavies. However, wash columns require large amounts of the absorbent wash fluid which is largely lost during the wash process. Therefore, the absorbent wash fluid must be continuously regenerated, which leads to increased expenses and can increase downtime during the liquefaction process. Furthermore, the absorbent wash fluid used in wash systems can contaminate the natural gas, creating a less desirable final product.

Another method of removing heavies can utilize natural gas liquids (NGLs) that are generated during the liquefaction process. Specifically, the NGLs dissolve the heavies present in the natural gas feed stream. In this method, the $C_2$-$C_5$ hydrocarbons present in the natural gas feed stream condense to form NGLs, which dissolve the heavies thereby preventing the heavies from solidifying. However, when insufficient amounts of C3 hydrocarbons are present in the natural gas feed stream, the heavy hydrocarbons within the feed stream can freeze before the NGL solvents are generated, or the feed stream may never generate a sufficient amount of NGL to adequately remove the heavy compounds. As the heavy hydrocarbon content approaches the limits of naturally occurring NGL solubility, the heavy hydrocarbons may freeze forming solids.

Stopping the liquefaction process to remove the frozen hydrocarbons can be expensive and time consuming, and is preferably avoided. Accordingly, a process is desired for preventing the C6+ hydrocarbons from freezing during the liquefaction process and removal of any C6+ hydrocarbons that may be present in the liquefaction process. It is further desired to remove excess C6+ hydrocarbon heavies from the natural gas.

It is with these observations in mind, among others, that various features of the present disclosure were conceived and developed.

SUMMARY

Implementations described and claimed herein generally relate to the liquefaction of natural gas. More particularly, but not by way of limitation, implementations of the present disclosure include systems and processes for removing heavies including, but not limited to, C6+ hydrocarbons, during the liquefaction of natural gas. As discussed above, processes and systems which are commonly used form natural gas liquids (NGLs) during the liquefaction of natural gas feed streams. However, in some instances the NGLs produced by the feed stream are not sufficient to remove the quantity of heavies present when the natural gas feed stream is low in C3+ hydrocarbons or when the natural gas contains an excess of C6+ hydrocarbons. Essentially, the composition of such feed streams will not naturally produce a sufficient amount of natural gas liquid (NGL) during the liquefaction process to dissolve the heavies present in the feed stream, causing the heavies to freeze during the liquefaction process. The processes and systems disclosed herein are designed to add external natural gas liquid (NGL) to the natural gas feed stream in order to correct this discrepancy.

During the liquefaction process, the external NGL can dissolve the heavies present in the natural gas feed stream and prevent them from freezing. The NGLs can then be removed and recycled to the beginning of the liquefaction process for reuse, which decreases overall costs and is environmentally friendly. The processes and systems described herein can be used where the natural gas feed streams are very rich in natural gas, for example those containing less than 90% methane and nitrogen, and an excess of C6+ heavy hydrocarbons; lean natural gas, for example containing more than 95% methane and nitrogen; and very lean natural gas, containing over 98% methane and nitrogen and little, if any, NGL; among others. In such feed streams, if external NGLs are not added to the natural gas feed stream the heavies present in the feed stream will freeze at the temperatures reached during the liquefaction process causing a buildup. As discussed above, the entire process must then be shut down in order to remove the buildup.

In an implementation, a process for removing heavies from natural gas includes preparing a mixture by combining a natural gas feed stream including a plurality of hydrocarbons with an external natural gas liquid (NGL), in a vessel; cooling the mixture in a first chiller to a temperature below about −30° C., generating a liquid portion and a gas portion; separating, via a separator, the liquid portion from the gas portion; cooling the gas portion in a second chiller to a temperature below about −45° C.; introducing the gas portion and the liquid portion into a first stripping column, wherein the gas portion is introduced towards the top of the first stripping column and the liquid portion is introduced below the gas; removing a liquid bottoms from the first stripping column from the bottom of the first stripping column, wherein the liquid bottoms comprises the external NGL and heavies dissolved therein; introducing the liquid bottoms into a second stripping column and separating a recyclable NGL from the heavies dissolved therein; and recycling the natural gas liquids to the vessel.

In another implementation, a heavies removal system with solvent recycle comprising a vessel configured to receive a natural gas feed stream and a solvent; a first chiller for cooling the natural gas feed stream and the solvent to a temperature below about −30° C.; a first separator for separating a gas stream from a liquid stream; a second separator for separating the gas stream from an additional liquid stream; a second chiller positioned between the first separator and the second separator, the second chiller for reducing the temperature of the gas stream to below about −45° C.; a first stripping column for separating out the gas stream from the liquid stream and the additional liquid stream; a second stripping column for separating out a methane gas stream and a liquid bottoms, the second stripping column including a liquid recycle line connecting the second stripping column to the vessel for transferring a recycled solvent to the vessel, and a heavies removal line connected to the bottom of the second stripping column to remove heavies from the stripping column.

Other implementations are also described and recited herein. Further, while multiple implementations are disclosed, still other implementations of the presently disclosed technology will become apparent to those skilled in the art from the following detailed description, which shows and described illustrative implementations of the presently disclosed technology. As will be realized, the presently disclosed technology is capable of modifications in various instances, all without departing from the spirit and scope of the presently disclosed technology. Accordingly, the drawings and detailed description are to be regarded as illustrative in nature and not limiting.

BRIEF DESCRIPTION OF THE DRAWINGS

The foregoing summary, as well as the following detailed description, will be better understood when read in conjunction with the appended drawing. For the purpose of illustration, there is shown in the drawing certain embodiments of the present inventive concept. It should be understood, however, that the present inventive concept is not limited to the precise embodiments and features shown. The accompanying drawing, which is incorporated in and constitutes a part of this specification, illustrates an implementation of apparatuses consistent with the present inventive concept and, together with the description, serves to explain advantages and principles consistent with the present inventive concept, in which.

DETAILED DESCRIPTION

Figure 1:
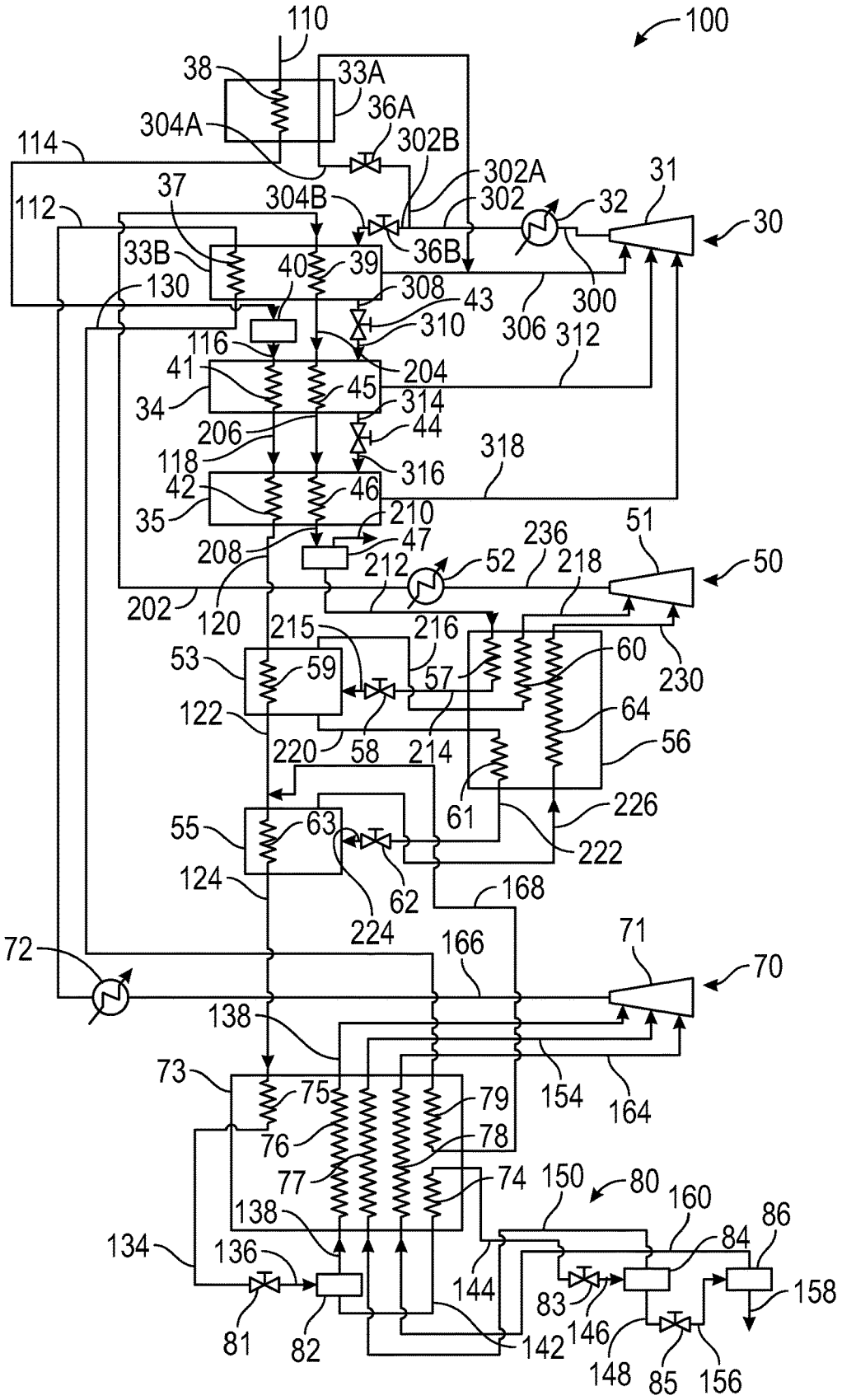
FIG. 1 illustrates an example simplified flow diagram of a cascade refrigeration process with a heavies removal system for removing freezing components during liquefied natural gas production.

The present disclosure relates generally to the liquefaction of natural gas, and to systems and processes for removing C6+ hydrocarbon heavies (hereinafter "heavies") from the natural gas feed stream using an external natural gas liquid (NGL) stream. The present disclosure further relates to the removal of trace amounts of non-condensable heavies in a wide range of natural gas compositions ranging from ethane, propane and butane to lean gas (>95 mol % methane and nitrogen), to very lean gas (98+mol % methane and nitrogen) by incorporating an external NGL stream to dissolve the non-condensable heavies. In at least one implementation, the natural gas feed stream can include a natural gas that contains a low amount of C3+ hydrocarbons. In another implementation, the natural gas feed can include a natural gas that contains a large amount of C6+ hydrocarbon heavies. Specifically, such natural gas feed streams do not contain a sufficient amount of natural gas liquid within the feed stream to dissolve the quantity of heavies present, adding an external NGL stream provides the necessary amount of NGL to dissolve the heavies and prevent freezing within the equipment. The amount of heavies present in the natural gas feed stream can be used to determine the amount of external NGLs are required to prevent freezing within the system. For example, if the natural gas feed stream contains a large amount of C6+ hydrocarbon heavies while having a high (such as greater than 95-98%) methane content, a larger amount of NGL may be used to prevent the C6+ heavies from freezing. For example, the composition of the natural gas feed stream can be evaluated to determine the amount of heavies present and the amount of NGLs the stream will produce. Once this ratio is determined, the amount of external NGL required to dissolve the heavies can be calculated.

Broadly, the systems and processes disclosed herein use a recyclable NGL to dissolve the heavies contained in a natural gas feed stream, generating a gas portion and a liquid portion, where the liquid portion comprises the NGL and the dissolved heavies. The gas portion can then be separated from the liquid portion using a staged process comprising at least two cooling and separation steps. The heavies are then removed from the liquid portion and the NGL is recycled to the beginning of the process, where it is combined with a fresh natural gas feed stream that contains heavies, thus continuing the heavies removal process. The inventors have surprisingly found that using a staged removal of the NGL and the dissolved heavies requires the use of less NGL as compared to methods using large sorbent beds or wash columns, dramatically lowers the cost of the heavies removal process, and provides a greener heavies removal process because the methods described herein do not require the regeneration of a sorbent. The processes and systems described herein has a minimal impact on the host liquefaction process and can be configured to work with a wide range of NGLs.

The presently disclosed technology thus reliably eliminates the buildup of frozen heavies within the heavies removal process, thereby improving the liquefaction of natural gas, among other advantages that will be apparent from the present disclosure.

I. Terminology

The liquefaction process described herein may incorporate one or more of several types of cooling systems and methods including, but not limited to, indirect heat exchange, vaporization, and/or expansion or pressure reduction.

Indirect heat exchange, as used herein, refers to a process involving a cooler stream cooling a substance without actual physical contact between the cooler stream and the substance to be cooled. Specific examples of indirect heat exchange include, but are not limited to, heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some implementations, expansion means may be a Joule-Thomson expansion valve. In other implementations, the expansion means may be either a hydraulic or gas expander. Because expanders recover work energy from the expansion process, lower process stream temperatures are possible upon expansion.

As used herein, "natural gas" refers to a gas feed stream comprising methane along with ethane, propane, butane, and pentane, as well as other components. Traditionally, natural gas referred to a naturally occurring hydrocarbon gas mixture consisting primarily of methane, but commonly including varying amounts of other higher alkanes, and sometimes a small percentage of carbon dioxide, nitrogen, hydrogen sulfide, or helium. The term "natural gas" today may be used to describe mixtures and gases produced from a variety of sources to create a combustible mixture of methane and other hydrocarbons. Depending upon the sources and mixtures, natural gas may be considered rich or lean dependent upon concentrations of methane as compared to other hydrocarbons. For example, a "lean" natural gas typically contains 95% or greater methane; whereas a "very lean" natural gas typically contains greater than 98% methane. On the contrary, a rich natural gas contains less than 90% methane. The terms "rich" and "lean" do not describe the content of other natural gas components present. For example a mixture of 90% methane may have varying concentrations of other hydrocarbons dependent upon the source or sources of the natural gas.

As used herein, "natural gas liquid" or "NGL" refers to hydrocarbons—in the same family of molecules as natural gas and crude oil, composed exclusively of carbon and hydrogen. NGLs can include ethane (C2H6), propane (C3H8), butane (C4H10), isobutene (C4H10), and pentane (C5H12) in various concentrations. NGLs may be all one component or may contain mixtures of various components, dependent upon processing and sources.

As used herein, "heavies," "heavy hydrocarbons," and "C6+ hydrocarbons" may be used interchangeably to refer to heavy hydrocarbon contaminants that may be present in a natural gas. Typically "heavies" refer to hexanes (C6H14) and heavier components such as heptanes (C7H16), octanes (C8H18), and nonanes (C9H20) that commonly separate from C1-C5 natural gas components in mass based separations, such as gas chromatography.

In the description, phraseology and terminology are employed for the purpose of description and should not be regarded as limiting. For example, the use of a singular term, such as "a", is not intended as limiting of the number of items. Also, the use of relational terms such as, but not limited to, "down" and "up" or "downstream" and "upstream", are used in the description for clarity in specific reference to the figure and are not intended to limit the scope of the present inventive concept or the appended claims. Further, any one of the features of the present inventive concept may be used separately or in combination with any other feature. For example, references to the term "implementation" means that the feature or features being referred to are included in at least one instance of the present disclosure. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the present inventive concept may include a variety of combinations and/or integrations of the implementations described herein. Additionally, all elements of the present disclosure as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

In order to liquefy a natural gas, the feed stream is cooled. During the process, heavies present in the natural gas feed stream can freeze, causing a buildup within the equipment used throughout the process. In at least one implementation, external NGLs are introduced into the process and systems described herein and used as a solvent to prevent the buildup. Specifically, the NGLs can dissolve the heavies present in the natural gas feed stream, thus preventing the heavies from freezing during the liquefaction process. External NGLs that can be used in accordance with the processes and systems described herein can include $C_2$-$C_5$+ hydrocarbons. Specific examples of NGLs can include, but are not limited to, ethane, propane, butane, isobutane, pentane, isopentane and pentanes plus (also known as natural gasoline). In one implementation, the NGL comprises a $C_2$-$C_6$ alkane. In another implementation, the NGL comprises a $C_4$ and/or $C_5$ hydrocarbon. In one implementation, the NGL comprises ethane and/or propane. In another implementation, the NGL comprises pentane and/or isopentane. In the systems and processes disclosed herein, at least one NGL, and commonly a mixture of two or more NGLs, is combined with the natural gas feed stream. As described above, during the liquefaction process the natural gas feed stream and external NGLs are separated into a liquid portion and a gas portion. The liquid portion contains the external NGL (or mixture of NGLs), the NGLs produced from the feed stream, and the dissolved heavies. The gas portion contains methane and little, if any, heavies. The gas portion is then further cooled, thereby removing additional heavies and other undesired components. In one implementation, the methane in the gas portion can contain heavies in an amount of parts per million or parts per billion levels.

In at least one implementation, the present disclosure can be implemented in a facility used to cool natural gas to its liquefaction temperature, and thereby produce liquefied natural gas (LNG). The LNG facility can employ one or more refrigerants to extract heat from the natural gas and reject the heat to the environment. Numerous configurations of LNG systems exist and may be used in conjunction with the heavies removal systems and the processes of using the heavies removal systems disclosed herein. In one preferred implementation, the devices and processes described herein are used in conjunction with a cascade LNG system.

A cascade LNG system employs a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. Examples of such cascades include using propane as the first refrigerant of the cascade, ethylene as the second refrigerant and methane as the third refrigerant. One preferred system and process for liquefying natural gas may be found in U.S. Pat. No. 9,791,209. All patents and applications disclosed herein are incorporated by reference, for all purposes.

In addition to cooling the natural gas stream through indirect heat exchange with one or more refrigerants, LNG system can employ one or more expansion cooling stages to simultaneously cool the LNG, while reducing its pressure.

In one implementation, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may include a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising three different refrigerants in three separate refrigeration cycles is made, this is not intended to be limiting. It is recognized that a cascade LNG process involving any number of refrigerants and/or refrigeration cycles may be compatible with one or more implementations of the presently disclosed technology. Other variations to the cascade LNG process are also contemplated. It will also be appreciated that the presently disclosed technology may be utilized in non-cascade LNG processes. One example of a non-cascade LNG process involves a mixed refrigerant LNG process that employs a combination of two or more refrigerants to cool the natural gas stream in at least one cooling cycle.

Figure 2:
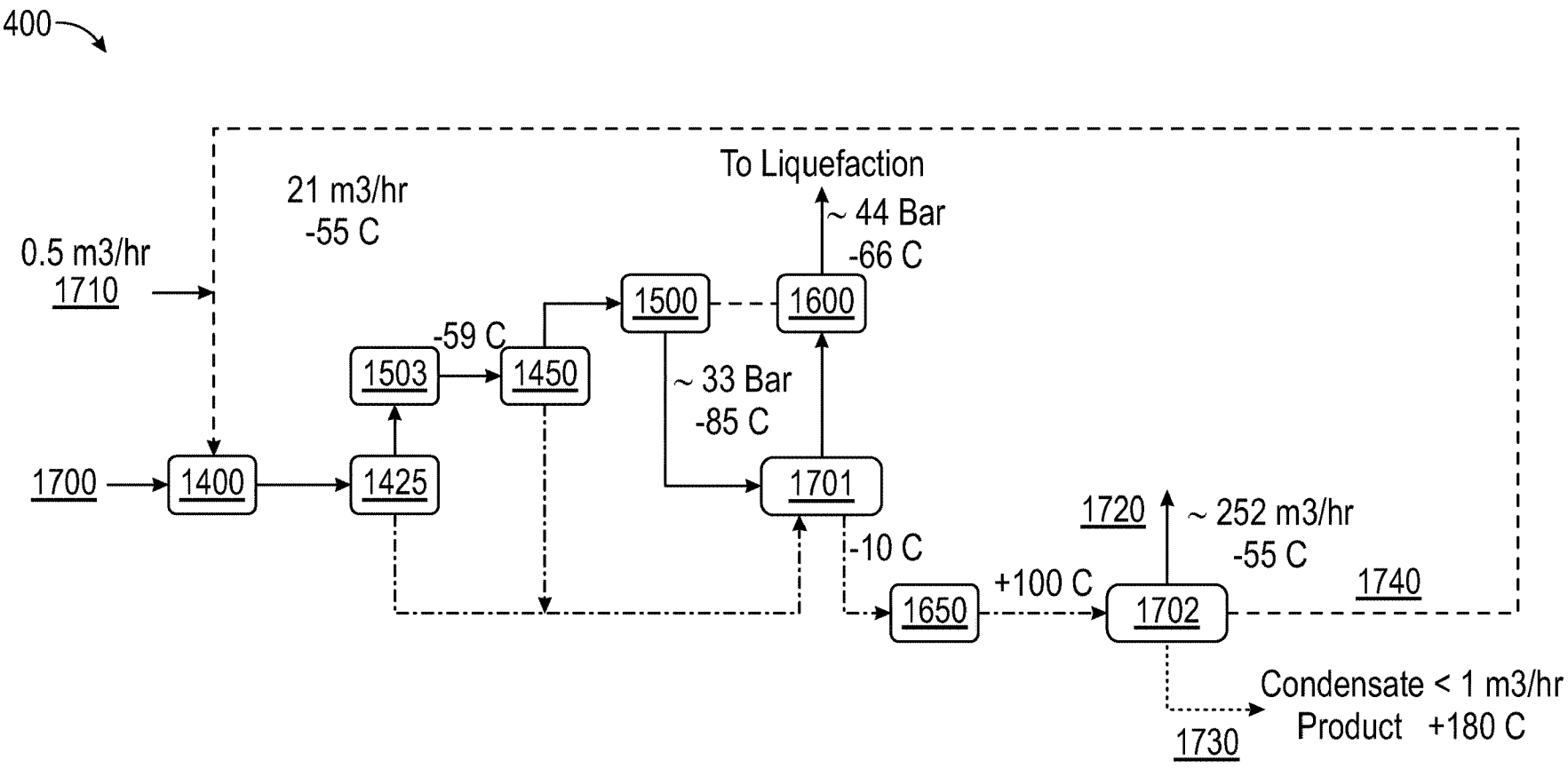
FIG. 2 illustrates a simplified flow diagram showing the flow of materials through an exemplary heavies removal system.
Figure 3:
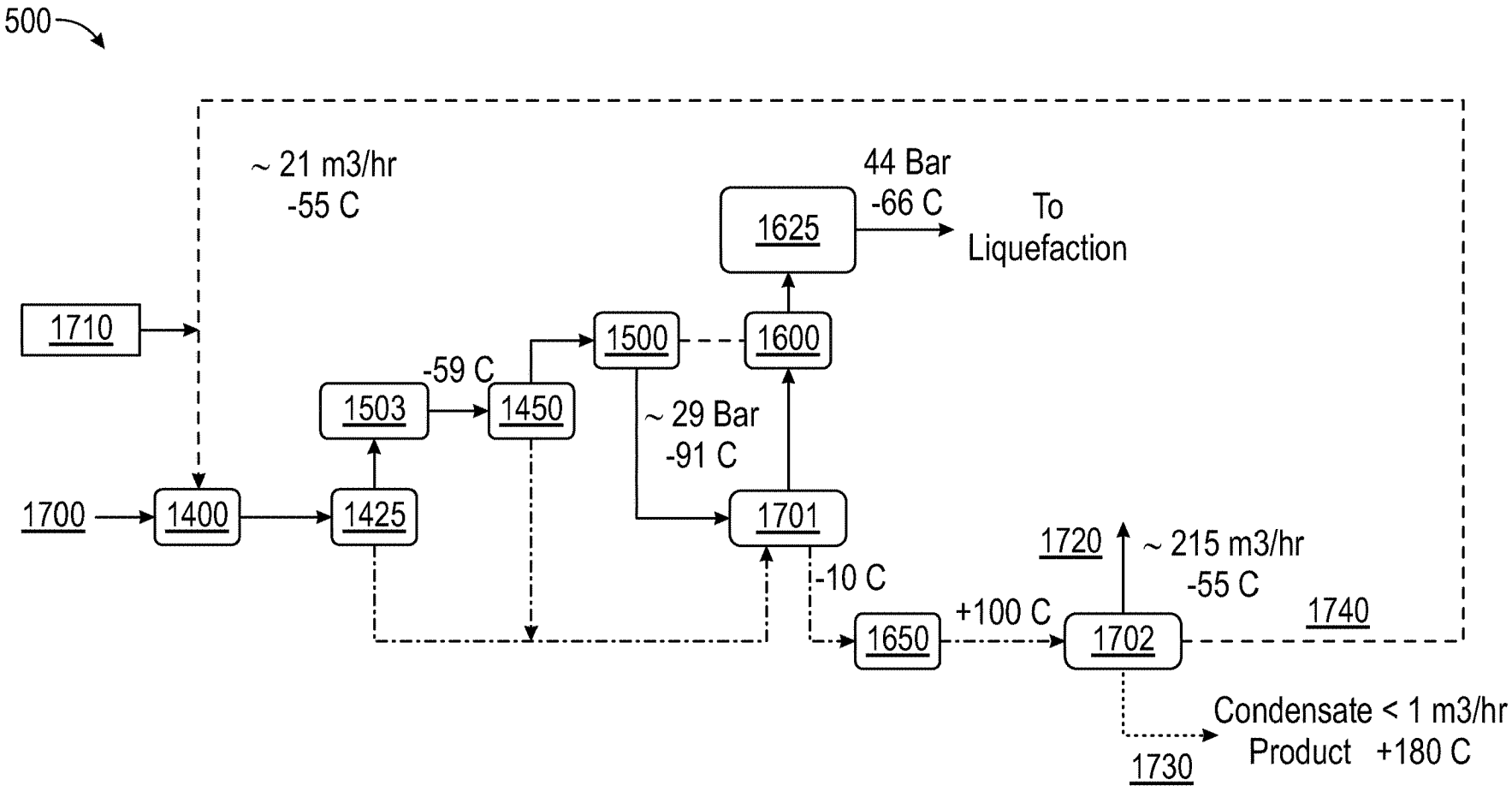
FIG. 3 illustrates an alternative, simplified flow diagram showing the flow of materials through a second exemplary heavies removal system.
Figure 4:
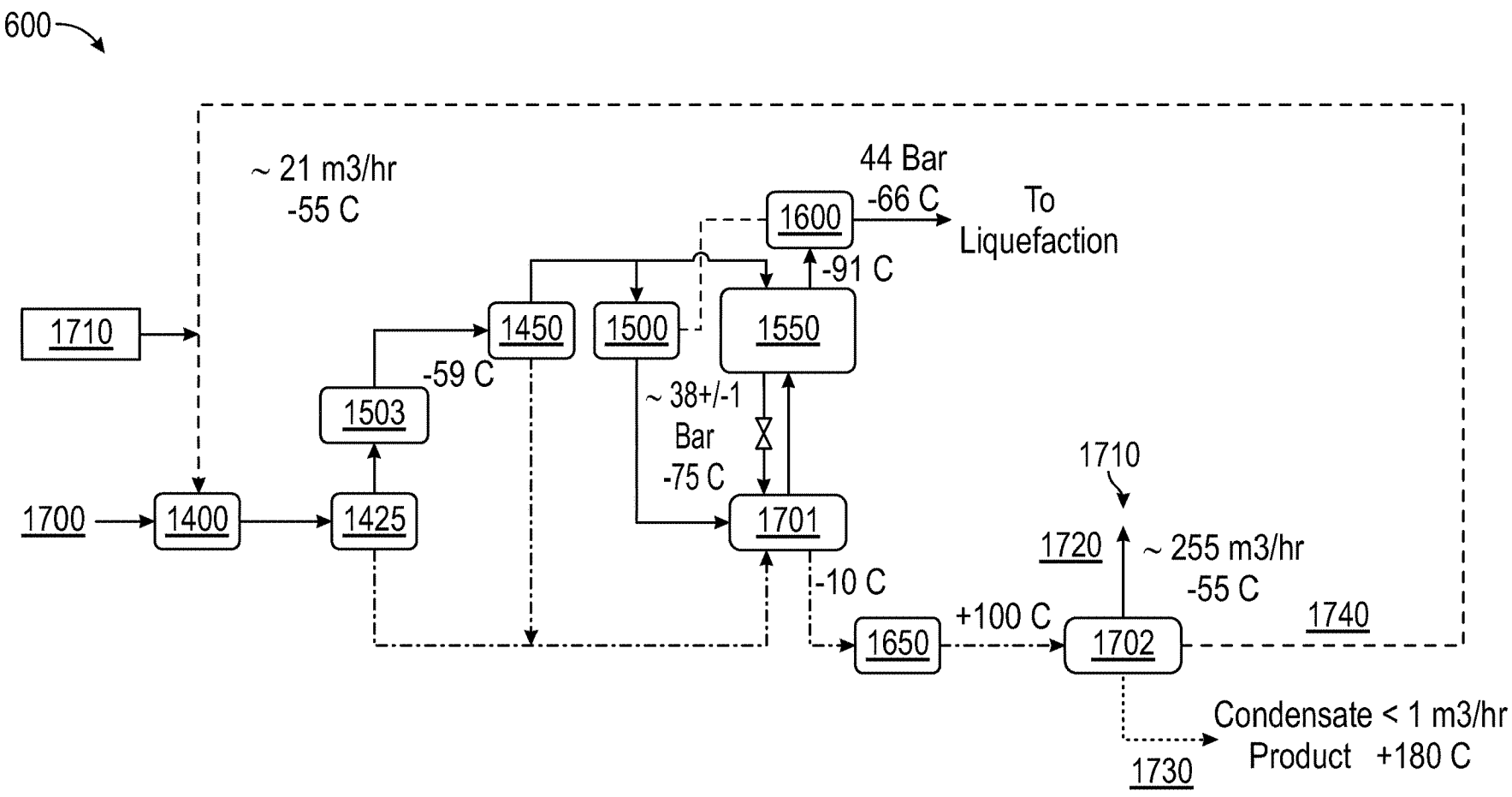
FIG. 4 illustrates a third alternative, simplified flow diagram showing the flow of materials through a third exemplary heavies removal system.

To begin a detailed description of an example cascade LNG facility 100 in accordance with the implementations described herein, reference is made to FIG. 1. The LNG facility 100 generally comprises a first refrigeration cycle 30 (e.g., a propane refrigeration cycle), a second refrigeration cycle 50 (e.g., an ethylene refrigeration cycle), and a third refrigeration cycle 70 (e.g., a methane refrigeration cycle) with an expansion section 80. FIGS. 2-4 illustrate an example heavies removal system 400 having an external NGL stream integrated with an LNG producing facility, such as the LNG facility 100. Those skilled in the art will recognize that FIGS. 1-4 are schematics only and, therefore, various equipment, apparatuses, or systems that would be needed in a commercial plant for successful operation have been omitted for clarity. Such components might include, for example, compressor controls, flow and level measurements and corresponding controllers, temperature and pressure controls, pumps, motors, filters, additional heat exchangers, valves, and/or the like. Those skilled in the art will recognize such components and how they are integrated into the systems and methods disclosed herein.

In one implementation, the main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expansion valve and/or expander 81, a high-stage methane flash drum 82, an intermediate-stage methane expansion valve and/or expander 83, an intermediate-stage methane flash drum 84, a low-stage methane expansion valve and/or expander 85, and a low-stage methane flash drum 86. While "propane," "ethylene," and "methane" are used to refer to respective first, second, and third refrigerants, it should be understood that these are examples only, and the presently disclosed technology may involve any combination of suitable refrigerants.

Referring to FIG. 1, in one implementation, operation of the LNG facility 100 begins with the propane refrigeration cycle 30. Propane is compressed in a multi-stage (e.g., three-stage) propane compressor 31 driven by, for example, a gas turbine driver (not illustrated). The stages of compression may exist in a single unit or a plurality of separate units mechanically coupled to a single driver. Upon compression, the propane is passed through a conduit 300 to a propane cooler 32 where the propane is cooled and liquefied through indirect heat exchange with an external fluid (e.g., air or water). A portion of the stream from the propane cooler 32 can then be passed through conduits 302 and 302A to a pressure reduction system 36A, for example, an expansion valve, as illustrated in FIG. 1. At the pressure reduction system 36A, the pressure of the liquefied propane is reduced, thereby evaporating or flashing a portion of the liquefied propane. A resulting two-phase stream then flows through a conduit 304A into a high-stage propane chiller 33A, which cools the natural gas stream in indirect heat exchange 38. A high stage propane chiller 33A uses the flashed propane refrigerant to cool the incoming natural gas stream in a conduit 110. Another portion of the stream from the propane cooler 32 is routed through a conduit 302B to another pressure reduction system 36B, illustrated, for example, in FIG. 1 as an expansion valve. At the pressure reduction system 36B, the pressure of the liquefied propane is reduced in a stream 304B.

The cooled natural gas stream from the high-stage propane chiller 33A flows through a conduit 114 to a separation vessel. At the separation vessel, water and in some cases a portion of the propane and/or heavier components are removed. In some cases where removal is not completed in upstream processing, a treatment system 40 may follow the separation vessel. The treatment system 40 removes moisture, mercury and mercury compounds, particulates, and other contaminants to create a treated stream. The stream exits the treatment system 40 through a conduit 116. The stream 116 then enters the intermediate-stage propane chiller 34. At the intermediate-stage propane chiller 34, the stream is cooled in indirect heat exchange 41 via indirect heat exchange with a propane refrigerant stream. The resulting cooled stream output into a conduit 118 is routed to the low-stage propane chiller 35, where the stream can be further cooled through indirect heat exchange means 42. The resultant cooled stream exits the low-stage propane chiller 35 through a conduit 120. Subsequently, the cooled stream in the conduit 120 is routed to the high-stage ethylene chiller 53.

A vaporized propane refrigerant stream exiting the high-stage propane chillers 33A and 33B is returned to a high-stage inlet port of the propane compressor 31 through a conduit 306. An un-vaporized propane refrigerant stream exits the high-stage propane chiller 33B via a conduit 308 and is flashed via a pressure reduction system 43, illustrated in FIG. 1 as an expansion valve, for example. The liquid propane refrigerant in the high-stage propane chiller 33A provides refrigeration duty for the natural gas stream. A two-phase refrigerant stream enters the intermediate-stage propane chiller 34 through a conduit 310, thereby providing coolant for the natural gas stream (in conduit 116) and the stream entering the intermediate-stage propane chiller 34 through a conduit 204. The vaporized portion of the propane refrigerant exits the intermediate-stage propane chiller 34 through a conduit 312 and enters an intermediate-stage inlet port of the propane compressor 31. The liquefied portion of the propane refrigerant exits the intermediate-stage propane chiller 34 through a conduit 314 and is passed through a pressure-reduction system 44, for example an expansion valve, whereupon the pressure of the liquefied propane refrigerant is reduced to flash or vaporize a portion of the liquefied propane. The resulting vapor-liquid refrigerant stream is routed to the low-stage propane chiller 35 through a conduit 316. At the low-stage propane chiller 35, the refrigerant stream cools the methane-rich stream and an ethylene refrigerant stream entering the low-stage propane chiller 35 through the conduits 118 and 206, respectively. The vaporized propane refrigerant stream exits the low-stage propane chiller 35 and is routed to a low-stage inlet port of the propane compressor 31 through a conduit 318. The vaporized propane refrigerant stream is compressed and recycled at the propane compressor 31 as previously described.

In one implementation, a stream of ethylene refrigerant in a conduit 202 enters the high-stage propane chiller 33B. At the high-stage propane chiller 33B, the ethylene stream is cooled through indirect heat exchange 39. The resulting cooled ethylene stream is routed in the conduit 204 from the high-stage propane chiller 33B to the intermediate-stage propane chiller 34. Upon entering the intermediate-stage propane chiller 34, the ethylene refrigerant stream may be further cooled through indirect heat exchange 45 in the intermediate-stage propane chiller 34. The resulting cooled ethylene stream exits the intermediate-stage propane chiller 34 and is routed through a conduit 206 to enter the low-stage propane chiller 35. In the low-stage propane chiller 35, the ethylene refrigerant stream is at least partially condensed, or condensed in its entirety, through indirect heat exchange 46. The resulting stream exits the low-stage propane chiller 35 through a conduit 208 and may be routed to a separation vessel 47. At the separation vessel 47, a vapor portion of the stream, if present, is removed through a conduit 210, while a liquid portion of the ethylene refrigerant stream exits the separator 47 through a conduit 212. The liquid portion of the ethylene refrigerant stream exiting the separator 47 may have a representative temperature and pressure of about −24° F. (about −31° C.) and about 285 psia (about 1,965 kPa). However, other temperatures and pressures are contemplated.

Turning now to the ethylene refrigeration cycle 50 in the LNG facility 100, in one implementation, the liquefied ethylene refrigerant stream in the conduit 212 enters an ethylene economizer 56, and the stream is further cooled by an indirect heat exchange 57 at the ethylene economizer 56. The resulting cooled liquid ethylene stream is output into a conduit 214 and routed through a pressure reduction system 58, such as an expansion valve. The pressure reduction system 58 reduces the pressure of the cooled predominantly liquid ethylene stream to flash or vaporize a portion of the stream. The cooled, two-phase stream in a conduit 215 enters the high-stage ethylene chiller 53. In the high-stage ethylene chiller 53, at least a portion of the ethylene refrigerant stream vaporizes to further cool the stream in the conduit 120 entering an indirect heat exchange 59. The vaporized and remaining liquefied ethylene refrigerant exits the high-stage ethylene chiller 53 through conduits 216 and 220, respectively. The vaporized ethylene refrigerant in the conduit 216 may re-enter the ethylene economizer 56, and the ethylene economizer 56 warms the stream through an indirect heat exchange 60 prior to entering a high-stage inlet port of the ethylene compressor 51 through a conduit 218. Ethylene is compressed in multi-stages (e.g., three-stage) at the ethylene compressor 51 driven by, for example, a gas turbine driver (not illustrated). The stages of compression may exist in a single unit or a plurality of separate units mechanically coupled to a single driver.

The cooled stream in the conduit 120 exiting the low-stage propane chiller 35 is routed to the high-stage ethylene chiller 53, where it is cooled via the indirect heat exchange 59 of the high-stage ethylene chiller 53. The remaining liquefied ethylene refrigerant exiting the high-stage ethylene chiller 53 in a conduit 220 may re-enter the ethylene economizer 56 and undergo further sub-cooling by an indirect heat exchange 61 in the ethylene economizer 56. The resulting sub-cooled refrigerant stream exits the ethylene economizer 56 through a conduit 222 and passes a pressure reduction system 62, such as an expansion valve, whereupon the pressure of the refrigerant stream is reduced to vaporize or flash a portion of the refrigerant stream. The resulting, cooled two-phase stream in a conduit 224 enters the low-stage ethylene chiller/condenser 55.

A portion of the cooled natural gas stream exiting the high-stage ethylene chiller 53 is routed through conduit a 122 to enter an indirect heat exchange 63 of the low-stage ethylene chiller/condenser 55. In the low-stage ethylene chiller/condenser 55, the cooled stream is at least partially condensed and, often, subcooled through indirect heat exchange with the ethylene refrigerant entering the low-stage ethylene chiller/condenser 55 through the conduit 224. The vaporized ethylene refrigerant exits the low-stage ethylene chiller/condenser 55 through a conduit 226, which then enters the ethylene economizer 56. In the ethylene economizer 56, vaporized ethylene refrigerant stream is warmed through an indirect heat exchange 64 prior to being fed into a low-stage inlet port of the ethylene compressor 51 through a conduit 230. As shown in FIG. 1, a stream of compressed ethylene refrigerant exits the ethylene compressor 51 through a conduit 236 and subsequently enters the ethylene cooler 52. At the ethylene cooler 52, the compressed ethylene stream is cooled through indirect heat exchange with an external fluid (e.g., water or air). The resulting cooled ethylene stream may be introduced through the conduit 202 into high-stage propane chiller 33B for additional cooling, as previously described.

The condensed and, often, sub-cooled liquid natural gas stream exiting the low-stage ethylene chiller/condenser 55 in a conduit 124 can also be referred to as a "pressurized LNG-bearing stream." This pressurized LNG-bearing stream exits the low-stage ethylene chiller/condenser 55 through the conduit 124 prior to entering a main methane economizer 73. In the main methane economizer 73, methane-rich stream in the conduit 124 may be further cooled in an indirect heat exchange 75 through indirect heat exchange with one or more methane refrigerant streams (e.g., 76, 77, 78). The cooled, pressurized LNG-bearing stream exits the main methane economizer 73 through a conduit 134 and is routed to the expansion section 80 of the methane refrigeration cycle 70. In the expansion section 80, the pressurized LNG-bearing stream first passes through a high-stage methane expansion valve or expander 81, whereupon the pressure of this stream is reduced to vaporize or flash a portion thereof. The resulting two-phase methane-rich stream in a conduit 136 enters into a high-stage methane flash drum 82. In the high-stage methane flash drum 82, the vapor and liquid portions of the reduced-pressure stream are separated. The vapor portion of the reduced-pressure stream (also called the high-stage flash gas) exits the high-stage methane flash drum 82 through a conduit 138 and enters into the main methane economizer 73. At the main methane economizer 73, at least a portion of the high-stage flash gas is heated through the indirect heat exchange means 76 of the main methane economizer 73. The resulting warmed vapor stream exits the main methane economizer 73 through the conduit 138 and is routed to a high-stage inlet port of the methane compressor 71, as shown in FIG. 1.

The liquid portion of the reduced-pressure stream exits the high-stage methane flash drum 82 through a conduit 142 and re-enters the main methane economizer 73. The main methane economizer 73 cools the liquid stream through indirect heat exchange 74 of the main methane economizer 73. The resulting cooled stream exits the main methane economizer 73 through a conduit 144 and is routed to a second expansion stage, illustrated in FIG. 1 as intermediate-stage expansion valve 83 and/or expander, as an example. The intermediate-stage expansion valve 83 further reduces the pressure of the cooled methane stream, which reduces a temperature of the stream by vaporizing or flashing a portion of the stream. The resulting two-phase methane-rich stream output in a conduit 146 enters an intermediate-stage methane flash drum 84. Liquid and vapor portions of the stream are separated in the intermediate-stage flash drum 84 and output through conduits 148 and 150, respectively. The vapor portion (also called the intermediate-stage flash gas) in the conduit 150 re-enters the methane economizer 73, wherein the vapor portion is heated through an indirect heat exchange 77 of the main methane economizer 73. The resulting warmed stream is routed through a conduit 154 to the intermediate-stage inlet port of methane compressor 71.

The liquid stream exiting the intermediate-stage methane flash drum 84 through the conduit 148 passes through a low-stage expansion valve 85 and/or expander, whereupon the pressure of the liquefied methane-rich stream is further reduced to vaporize or flash a portion of the stream. The resulting cooled two-phase stream is output in a conduit 156 and enters a low-stage methane flash drum 86, which separates the vapor and liquid phases. The liquid stream exiting the low-stage methane flash drum 86 through a conduit 158 comprises the liquefied natural gas (LNG) product at near atmospheric pressure. This LNG product may be routed downstream for subsequent storage, transportation, and/or use.

A vapor stream exiting the low-stage methane flash drum 86 (also called the low-stage methane flash gas) in a conduit 160 is routed to the methane economizer 73. The methane economizer 73 warms the low-stage methane flash gas through an indirect heat exchange 78 of the main methane economizer 73. The resulting stream exits the methane economizer 73 through a conduit 164. The stream is then routed to a low-stage inlet port of the methane compressor 71.

The methane compressor 71 comprises one or more compression stages. In one implementation, the methane compressor 71 comprises three compression stages in a single module. In another implementation, one or more of the compression modules are separate but mechanically coupled to a common driver. Generally, one or more intercoolers (not shown) are provided between subsequent compression stages.

As shown in FIG. 1, a compressed methane refrigerant stream exiting the methane compressor 71 is discharged into a conduit 166. The compressed methane refrigerant is routed to the methane cooler 72, and the stream is cooled through indirect heat exchange with an external fluid (e.g., air or water) in the methane cooler 72. The resulting cooled methane refrigerant stream exits the methane cooler 72 through a conduit 112 and is directed to and further cooled in the propane refrigeration cycle 30. Upon cooling in the propane refrigeration cycle 30 through a heat exchanger 37, the methane refrigerant stream is discharged into s conduit 130 and subsequently routed to the main methane economizer 73, and the stream is further cooled through indirect heat exchange 79. The resulting sub-cooled stream exits the main methane economizer 73 through a conduit 168 and then combined with the stream in the conduit 122 exiting the high-stage ethylene chiller 53 prior to entering the low-stage ethylene chiller/condenser 55, as previously discussed.

Various pretreatment steps can remove some of the undesirable components from the natural gas feed stream. Pretreatment steps may be separate steps located either upstream of cooling cycles or located downstream of one of the early stages of cooling, in the initial cycle. Such pretreatment steps are readily known to one skilled in the art. For example, acid gases and to a lesser extent mercaptan can be removed via a chemical reaction process employing an aqueous amine-bearing solution. This treatment step is generally performed upstream of the cooling stages in the initial cycle. A major portion of the water can be removed as a liquid via two-phase gas-liquid separation following gas compression and cooling upstream of the initial cooling cycle and also downstream of the first cooling stage in the initial cooling cycle. Mercury can be removed via mercury sorbent beds. Residual amounts of water and acid gases are routinely removed via the use of properly selected sorbent beds, such as regenerable molecular sieves.

The pretreated natural gas feed stream is generally delivered to the liquefaction process at an elevated pressure or is compressed to an elevated pressure generally greater than 500 psia, between about 500 psia to about 3000 psia, between about 500 psia to about 1000 psia, between about 600 psia to about 800 psia. Temperature of the pretreated natural gas feed stream is typically near ambient to slightly below ambient. A representative temperature range is from about 60° F. (16° C.) to about 77° F. (25° C.).

The liquefaction processes described herein may incorporate one of several types of cooling means including, but not limited to: (a) indirect heat exchange, (b) vaporization, and (c) expansion or pressure reduction. Indirect heat exchange, as used herein, refers to a process in which the refrigerant cools the substance to be cooled without actual physical contact between the refrigerating agent and the substance to be cooled. Specific examples of indirect heat exchange means include heat exchange undergone in a shell-and-tube heat exchanger, a core-in-shell heat exchanger, a brazed aluminum plate-fin heat exchanger, and a printed circuit heat exchanger. The specific physical state of the refrigerant and substance to be cooled can vary depending on demands of the refrigeration system and type of heat exchanger chosen. For example, a shell-and-tube heat exchanger may be utilized where the refrigerant is in a liquid state and the substance to be cooled is in a liquid or gaseous state or when one of the substances undergoes a phase change and process conditions do not favor the use of a core-in-shell heat exchange. In some embodiments, aluminum and aluminum alloys may be used in constructing the core.

A plate-fin heat exchanger may be utilized where the refrigerant is in a gaseous state and the substance to be cooled is in a liquid or gaseous state. The core-in-shell heat exchanger may be utilized where the substance to be cooled is liquid or gas and the refrigerant undergoes a phase change from a liquid state to a gaseous state during the heat exchange. Another heat exchanger that may be used is the printed circuit heat exchanger, which can be used to cool liquids and gases. This type of heat exchanger is made from a plurality of metal plates, commonly stainless steel, and it contains micro-channels, through which the fluids flow. They may be coupled with a strainer, which can remove particles or otherwise prevent undesired components from entering the heat exchanger.

Vaporization cooling refers to the cooling of a substance by evaporation or vaporization of a portion of the substance at a constant pressure. During vaporization, portion of the substance which evaporates absorbs heat from portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In some embodiments, expansion means may be a Joule-Thomson expansion valve. In other embodiments, the expansion means may be either a hydraulic or gas expander. Because expanders recover work energy from the expansion process, lower process stream temperatures are possible upon expansion.

Solid deposition can occur early in the LNG process (i.e. the relatively warmer section of the cryogenic process). For example, when processing "lean" feed gases, which contain relatively low concentrations of mid-range components (C2-C5) but high concentrations of heavies (C6-C11 and C12+) such depositions can occur. Typically, C6-C11 hydrocarbon freezing occurs at the later section in the LNG process. However, with cryogenic conditions required for liquefying the natural gases, C12+ hydrocarbons often forms solid deposition on the process equipment even when only trace concentrations are present, which can be problematic for plant operation and impairs LNG production. Stated broadly, LNG plant feedstocks often contain heavy hydrocarbon components which tend to form solids (i.e. "freeze") at the cryogenic temperatures required for a natural gas liquefaction process. If freezing occurs, the heavy components deposit on the process equipment in the cold sections of the plant, which could eventually plug the equipment and result a plant shutdown. The external NGL stream of the presently disclosed technology absorbs the heavies, preventing freezing issues caused by such "lean" feed gases, therefore preventing the equipment from detriment. Various implementations of a heavies removal system which can be used in conjunction with or integrated into the LNG system of FIG. 1 are illustrated in FIGS. 2-4.

Reference will now be made in detail to embodiments of the disclosure; such examples are illustrated in FIGS. 2-4. Each example is provided by way of explanation of the disclosure, not as a limitation of the disclosure. It will be apparent to those skilled in the art that various modifications and variations can be made in the present disclosure without departing from the scope or spirit of the disclosure. For instance, features illustrated or described as part of one embodiment can be used on another embodiment to yield a still further embodiment. Thus, it is intended that the present disclosure cover such modifications and variations that come within the scope of the disclosure.

FIG. 2 illustrates a first embodiment of a heavies removal system 400 which can be used to remove heavies from a natural gas free stream. As shown in FIG. 2, a natural gas feed stream 1700 can enter a first chilling vessel 1400, where it is combined with an external NGL 1710 and cooled. As discussed above, the external NGL 1710 can be a single hydrocarbon or a combination of multiple hydrocarbons. In at least one implementation the composition of the external NGL can be determined based on the composition of the natural gas feed stream. As the natural gas feed stream and the external NGL are cooled, a cooled mixture is produced including a gas portion and a liquid portion. The gas portion can include methane and little, if any, heavies. The liquid portion can include the external NGLs, the NGLs produced by the cooling of the natural gas feed stream, and the dissolved heavies. The cooled mixture can then enter a first separator 1425, where the gas portion (also referred to a gas stream) is separated from the liquid portion (also referred to as a liquid stream). For the purposes of FIGS. 2-4, the gas streams are indicated using a solid line, the liquid stream having NGL and dissolved heavies is indicated using a dash-dot line. The liquid stream, which contains the NGLs and dissolved heavies, can exit the bottom of the first separator 1425 and proceed to first stripping column 1701.

The gas stream can exit at the top of the first separator 1425 and enter a second chiller 1503, where the temperature is further reduced. In at least one implementation, the reduction in temperature can cause additional liquids to form. While not shown in FIG. 2, the chilling vessel 1400 can be cooled with a coolant comprising propane, while the second chiller 1503 can be cooled with a coolant comprising ethane or ethylene. The gas stream and any additional liquids produced can then enter a second separator 1450, where additional liquid (indicated using a dash-dot line) is separated from the gas (indicated using a solid line). In at least one implementation, as shown in FIG. 2, the liquid stream from the first separator 1425 and the additional liquid produced in the second separator 1450 can be combined prior to entering the first stripping column 1701. In an alternative implementation, the liquid stream from the first separator 1425 and the liquid stream from the second separator 1450 may enter first stripping column 1701 separately, such as entering the stripping column 1701 at different heights.

Referring back to the gas stream exiting the second separator 1450, the gas stream can exit the second separator 1450 and pass through an expander 1500, where it is cooled another 20-30° C. The gas stream can then enter stripping column 1701 towards the top of the column. In stripping column 1701, a desired gas comprising methane is separated from the liquid stream comprising the NGLs and dissolved heavies. The methane gas leaves stripping column 1701 and can pass through compressor 1600, where the temperature and the pressure are increased, before it returns to the liquefaction process 100. As shown in FIG. 2, compressor 1600 and expander 1500 can be connected.

The liquid stream, containing NGL and dissolved heavies (represented by a dash-dot line), can exit the stripping column 1701 and pass through a heat exchanger or other heating device 1650, where it is warmed. Once the liquid stream is warmed, some, and preferably most, of the gases dissolved in the liquid stream or otherwise combined with the liquid stream are separated and gasified. The warmed liquid can then enter a second stripping column 1702, where three streams are generated. The three streams can include a gas stream 1720, which can comprise methane and other light hydrocarbons; a first liquid stream 1730 including the separated heavies, and a second liquid stream 1740 including recyclable NGLs. The gas stream is indicated using a solid line, the recyclable NGL is indicated using a dash line, and the heavies are indicated using a dotted line.

The gas stream 1720 can be sent to the methane system where it is further purified and/or used for heating purposes. The first liquid stream 1730 can be further processed to isolate the heavies, which can be then be sold as is and/or used as fuel. The temperature of the heavies liquid stream 1730 can be maintained high enough to ensure the heavies will flow without freezing. The recyclable NGL stream 1740 can be recycled to chilling vessel 1400. In at least one implementation, as shown in FIG. 2, fresh external NGL 1710 can be combined with the recycled NGL 1740, and the combined stream can enter chilling vessel 1400 together. In an alternative, the fresh external NGL 1710 and the recycled NGL 1740 may enter the chiller 1400 separately. In at least one implementation, the external NGL added after the first cycle is minimal, due to the efficiency of the recyclable NGL 1740.

FIG. 3 illustrates a heavies removal system 500 that is related to the heavies removal system 400 as shown in FIG. 2, with slight alterations. Specifically, in the process as shown in FIG. 3, the gas leaving column 1701 passes through compressor 1600, where the pressure is increased, and then it passes through a booster compressor 1625, where its pressure is further increased. After the gas stream passes through booster compressor 1625, the gas stream can return to the liquefaction process.

In yet another implementation of the heavies removal system 600, as shown in FIG. 4, can include a natural gas feed stream 1700 can enter a chilling vessel 1400, where it is combined with an external NGL 1710 stream and cooled to approximately −35° C. The cooled streams can result in the formation of a mixture including a gas and a liquid. As described above, the liquid portion can include the external NGLs, the NGLs produced by the cooling of the natural gas stream, and the dissolved heavies. The gas and liquid mixture can then enter the first separator 1425, where the gas stream is separated from the liquid stream. The liquid stream, which contains the NGLs and dissolved heavies, can enter the first stripping column 1701 as indicated by the dash-dot line.

The gas stream can leave the first separator 1425 and enter a second chiller 1503, where the temperature is further reduced by another 20-30° C. In at least one implementation, the reduction in temperature can cause additional liquid to be formed. While not shown in FIG. 4, the chilling vessel 1400 can be cooled with a coolant comprising propane, while the second chiller 1503 can be cooled with a coolant comprising ethylene. The gas stream can then enter a second separator 1450, where the cooled gas stream and additional liquid stream are separated. In at least one implementation, the additional liquid stream from the second separator 1450 can be combined with the liquid stream from the first separator 1425 and the combined liquid streams can enter the first stripping column 1701 together. In the alternative, the liquid stream from the first separator 1425 and the additional liquid stream from the second separator 1450 may enter the first stripping column 1701 separately, such as at different heights within the stripping column 1701.

Referring back to the gas stream, after the gas stream leaves the second separator 1450 and at least a portion of the gas stream can pass through an expander 1500, where it is cooled, while a second portion of the gas stream can pass through heat exchanger 1550, where it is cooled, followed by a Joule Thomson expansion valve 1575, where it is further cooled. As shown in FIG. 4, the two portions of the gas stream can enter then the first stripping column 1701, where a methane containing gas is separated from a liquid comprising NGLs and dissolved heavies. The gas stream leaving the top of the first stripping column 1701 can pass through a heat exchanger 1550, and since the heavies were removed, there is no risk of hydrocarbons freezing in the heat exchanger 1550. In the heat exchanger 1550, the gas stream is cooled to about −90°, before entering a compressor 1600, where its pressure is increased, and its temperature is decreased. The temperature of the gas leaving the compressor 1600 is less than −60° C. The gas stream can then return to the liquefaction process. As shown in FIG. 4, compressor 1600 and expander 1500 can be connected. In one implementation, the heavies removal system 600 as illustrated in of FIG. 4 is preferred.

The liquid stream leaving the bottom of stripping column 1701 can have a temperature of about −10° C. As such, the liquid stream leaving stripping column 1701 can be warmed using a heat exchanger 1650 before it enters the second stripping column 1702. In second stripping column 1702, three streams are formed, a gas stream 1720, a heavies stream 1730, and a recyclable NGL stream 1740. The gas stream 1720 can include methane and other lights and can be sent to the methane system where it is further purified and/or used for heating purposes.

The heavies stream 1730 which can comprise heavies and various other components. The heavies stream 1730 can be further processed to isolate the heavies which can then be sold as is and/or used as fuel. The temperature of the liquid stream 1730 can be maintained high enough to ensure the heavies will flow without freezing. The recycled NGL stream 1740 can be recycled back to chilling vessel 1400. In at least one implementation, as shown in FIG. 4, fresh external NGL 1710 can be combined with the recycled NGL 1740, and the combined NGL streams can enter chilling vessel 1400 together. In an alternative implementation, the fresh NGL 1710 and the recycled NGL 1740 may enter the chiller 1400 separately. As indicated above, the external NGL 1710 added after the initial processing cycle can be minimal, due to the efficiency of the recycle process.

Figure 5:
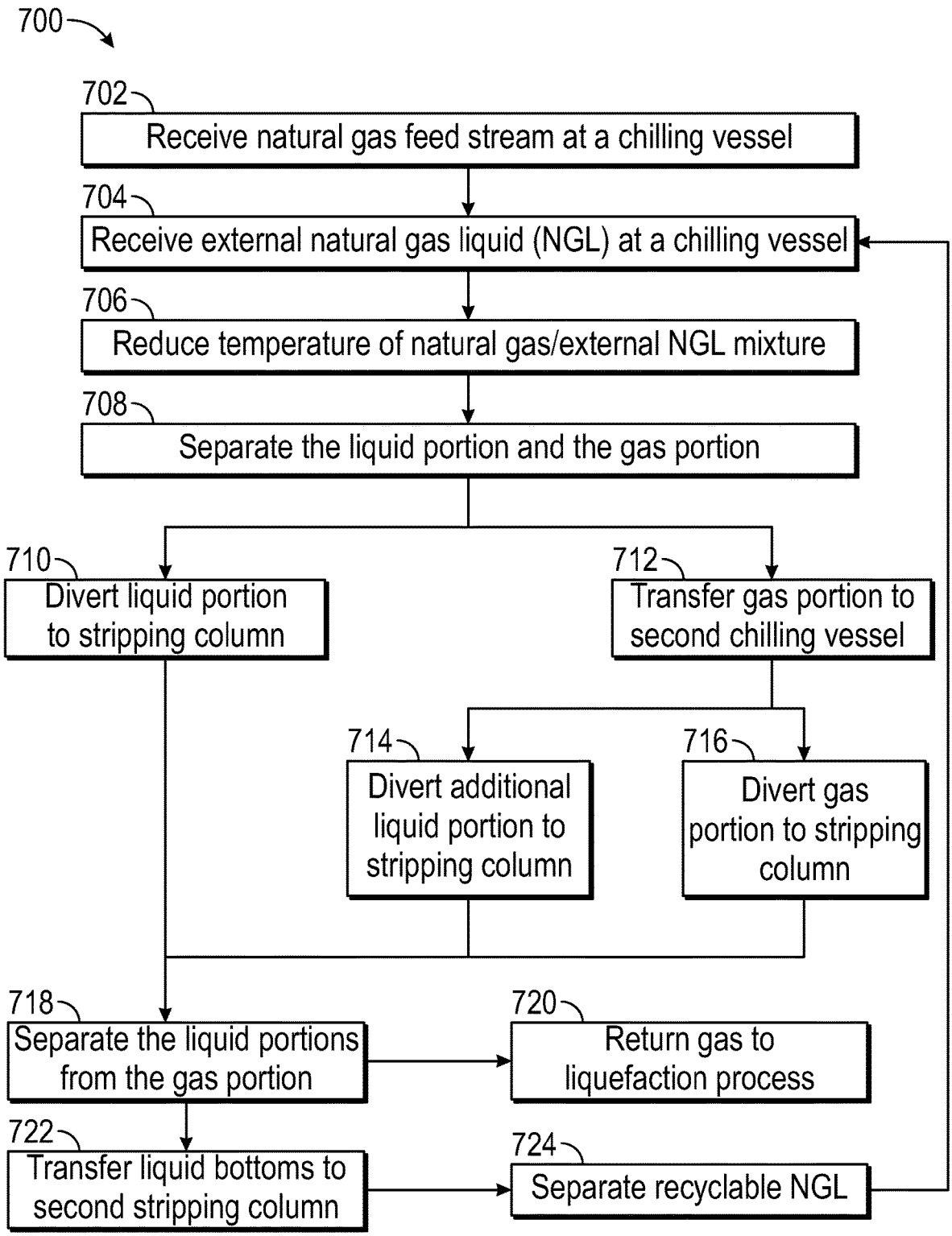
FIG. 5 is a flow chart illustrating a method for removing heavies from a natural gas feed stream.

FIG. 5 illustrates a flow chart showing a method 700 for removing heavies from a natural gas feed stream using at least one of the heavies removal systems shown in FIGS. 2-4. The method 700 can begin at block 702, where a natural gas is received in a chilling vessel. In at least one implementation, the natural gas can be any stream principally comprised of methane, which originates in major portion from a natural gas feed stream, such feed stream for example may contain at least 90 wt % methane and nitrogen, with the balance of the stream being undesirable components such as ethane, C6+ hydrocarbons, nitrogen, carbon dioxide, and a minor amount of other contaminants such as mercury, water, hydrogen sulfide, and mercaptan. In an alternative implementation, the natural gas processed using the processes and heavy removal units described herein is very rich natural gas, having high concentrations of heavies contamination. In another implementation, the natural gas is lean natural gas with insufficient NGL concentration. In still another implementation, the natural gas is very lean natural gas comprising high levels of methane.

At block 704, an external NGL is added to the chilling vessel. The amount of external NGLs required is dependent on the amount of undesirable components in the feed stream subjected to liquefaction. Specifically, the amount of external NGLs added to the chilling vessel should be sufficient to dissolve the heavies present in the natural gas feed stream. The external NGLs dissolves the heavies to create a heavies rich NGL where there is no thermodynamic potential of solids forming during the liquefaction process. For example, about 100 $m^3$/h to about 450 $m^3$/h of external NGL can be used relative to a feed stream of approximately 1,000,000 $Nm^3$/h of natural gas. In an alternative example, about 150 $m^3$/h to about 400 $m^3$/h, or about 200 $m^3$/h to about 300 $m^3$/h of external NGL can be used relative to a feed stream of approximately 1,000,000 $Nm^3$/h of natural gas. In the alternative, when a feed stream of greater than or less than 1,000,000 $Nm^3$/h of natural gas is processed, a ratio of 0.1-0.5 Liters external NGL may be used per normal cubic meters of natural gas. In at least one implementation, the composition of the natural gas feed stream is determined such that the amount of non-condensable heavies is known. The ratio of external NGL to natural gas can be adjusted dependent upon the amounts of non-condensable heavies present in the natural gas stream and the processing requirements. For example, the external NGL to natural gas ratio may be selected from 0.1, 0.15, 0.2, 0.25, 0.3, 0.35, 0.4, 0.45, and 0.5 Liters external NGL per $Nm^3$ of gas.

As described in detail above, the processes and systems disclosed herein require the use of less external NGL solvent as compared to conventional NGL wash system. In one implementation, the processes and systems disclosed herein use about 10% less NGL, about 20% less NGL, about 30% less NGL, about 40% less NGL, or about 50% less NGL than conventional wash columns. Additionally, the systems described herein can be readily configured to work with any NGL stream comprising ethane, propane, butane, isobutane, pentane, pentanes plus, and mixture of two or more thereof. Integrating the presently described processes and systems into a natural gas liquefaction plant minimizes the energy requirements. The use of devices, such as heat recovery heat exchangers to generate additional reflux can improve the separation of the heavies. Further, the use of an expander-compressor pair allows the heavy removals unit to operate at lower pressure, which reduces the amount of the external NGL lost to the liquid natural gas (LNG) product stream. For example, when the liquefaction process is run at higher pressures, more of the external NGL does not condense and is lost to the LNG product stream.

At block 706, the temperature of the external NGL and the natural gas feed stream is reduced. The temperature of the external NGL and the natural gas feed stream (containing heavies) can be reduced to about −30° C., about −40° C., about −50° C., or below in the chilling vessel. In at least one implementation, a temperature below −20° C. is preferred. The exact temperature to which the materials are chilled depends at least in part on the type and amount of heavies being removed and the amount of materials entering the chiller. In at least one example, a refrigerant comprising propane is used to cool the first chiller. In the first chiller, a chilled mixture comprising a gas portion and a liquid portion (also referred to as the liquid from the first chiller) is formed. In at least one implementation, the external NGL and the natural gas feed stream are combined before they enter the first chiller. In an alternative implementation, the external NGL and the natural gas feed stream separately enter the first chiller.

As the temperature drops, a mixture forms within the chiller, having a gas portion and a liquid portion. The liquid portion can contain the external NGLs and the dissolved heavies. As previously noted, the external NGL can include ethane, propane, butane, isobutane, pentane, isopentane or a combination of two or more thereof. In some implementations, the natural gas feed stream can contain methane, heavies, and one or more of ethane, propane, butane, isobutane, pentane, or isopentane. Thus, in some circumstances, the compound being used as the external NGL is also inherently present in the natural gas feed stream. When this occurs, the amount of external NGL added to the natural gas can be decreased. For example, if the natural gas stream contains propane, and the external NGL contains propane, then less external NGL (i.e., propane) is required because the natural gas already contains some propane. As the natural gas feed stream cools, the NGLs present in the feed stream will combine with the external NGLs. In at least one implementation, the liquid portion can include external NGLs, NGLs produced by the natural gas feed stream, and the dissolved heavies.

At block 708, the chilled mixture enters a first separator, where the gas portion and the liquid portion are separated. The liquid portion, including NGLs and dissolved heavies, can proceed to a first stripping column, as shown in block 710.

At block 712, the gas portion can enter a second chiller, where it is further cooled. In the second chiller, the temperature of the gas portion is decreased even further, which can cause a second liquid portion (also referred to as the liquid from the second chiller) to be formed. When a second liquid portion is formed, the method can proceed to block 714, where the second liquid portion is combined with the first liquid portion. In at least one implementation, the second liquid portion may be combined with the liquid portion from the first separator prior to entering stripping column. In the alternative, the second liquid portion may independently be introduced into the first stripping column. In yet another alternative, the liquid portion from the second chiller is not combined with the liquid portion from the first chiller. In some implementations, a liquid is not formed in the second chiller.

The gas leaving the second chiller can be at a temperature of less than about −40° C., less than about −50° C., less than about −60° C., less than about −70° C., or below. In one implementation, the gas is chilled in the second chiller to a temperature of about −55° C. or below, or about −60° C. or below. In another implementation, the gas is chilled in a second chiller to a temperature of about −55° C. to about −70° C. The refrigerant used to cool the gas in the second chiller may comprise ethylene.

At block 714, the gas leaving the second separator can be further cooled through the use of an expander, a heat exchanger and/or an expansion valve, such as a Joule Thomson valve. As is known, an expander lowers the temperature and pressure of a gas passing through it. Thus, the temperature of the gas entering the first stripping column is less than the temperature of the gas leaving the second chiller. In one implementation, the temperature of the gas is about −65° C. to about −100° C., or about −70° C. to about −95° C. The pressure of the second portion is about 20 to about 50 bar, or about 25 to about 45 bar. In one implementation, the pressure is less than 40 bar. In at least one implementation, the expander may work in conjunction with a compressor, which in the art is referred to as a turboexpander. An advantage of the turboexpander is the recovery of useful work from a high-temperature and/or high-pressure gas. In an implementation, less than 50 wt % of the gas passes through a heat exchanger, where it is cooled, then through a Joule Thomson valve where it is further cooled, and then into the top of the first stripping column. In this implementation, more than 50 wt % of the gas passes through an expander, to reduce the temperature and pressure of the gas, before it enters the first stripping column. In an alternate implementation, more than 50 wt % of the gas passes through an expansion valve, rather than an expander and/or a turboexpander. At block 716, the gas from the expander enters the stripping column.

At block 718, the liquid portion and the gas portion are further separated. Specifically, in the first stripping column, the desired gas, which comprises methane and at least some of the external NGL, can separated from the liquid NGL/heavies mixture.

At block 720, the gas portion comprising methane can leave the top of the stripping column. The pressure in the first stripping column can be about 10 bar to about 50 bar, or about 20 bar to about 40 bar. If the pressure in the first stripping column is kept low, such as around 10-20 bar, the amount of external NGL that leaves the top of the first stripping column with the methane can be decreased. In the alternative, if the pressure is kept high, such as around 30-40 bar, a larger amount of the external NGL will leave the top of the stripping column. However, at least some portion of the external NGL will leave through the top of the column mixed with methane irrespective of the actual pressure. As a result, the external NGL levels will decrease over time, unless additional external NGL is added. The additional external NGL can be added to the process either as fresh external NGL, or as recycled external NGL. The gas leaving the column can pass through at least one compressor (or in some implementations, two compressors) and/or a heat exchanger, before it is routed to the liquefaction process. In one implementation, the gas can go through at least one compressor before being routed to the liquefaction process. The pressure of the gas returning to the liquefaction process can be at least about 25 bar, at least about 30 bar, at least about 35 bar, at least about 40 bar, at least about 45 bar, or at least about 50 bar. The temperature of the gas returning to the liquefaction process can be less than about −20° C. but greater than about −110° C. For example, the temperature of the gas can be about −30° C. to about −90° C., or about −40° C. to about −75° C. In an alternate implementation, the gas stream comprising methane exits the first stripping column and enters a heat exchanger, where it is warmed, while a portion of the gas from the second separator passes through the same heat exchanger and is cooled.

At block 722, the liquid bottoms, comprising the external NGL and dissolved heavies, can exit the bottom of the stripping column and enter a second stripping column. The temperature of the liquid bottoms as it leaves the bottom of the first stripping column can be below about 10° C., below about 0° C., below about −10° C., or below about −20° C. In at least one implementation, the liquid can then be warmed, which facilitates the separation of any gases entrained therein, when the warmed liquid enters a second stripping column. The temperature of the warmed liquid bottoms can be greater than about 0° C. or greater than about 25° C. In other implementations, the temperature of the warmed liquid bottoms can be at least about 50° C., at least about 75° C., at least about 100° C., or at least about 125° C.

In the second stripping column, the warmed liquid bottoms can be divided into three separate streams. A first stream including lights, which comprise methane as defined above, can be sent to the methane system. The lights leaving the second stripping column are can be at a temperature of about −25° C. to about −75° C. or about −40° C. to about −60° C. The pressure of the lights leaving the second column can be adjusted as needed.

A second stream including the heavies which have been separated from the NGL, as described above. For example, the heavies can be further purified, chemically modified, and/or burned as fuel. Importantly, the heavies are maintained at a temperature that ensures they are liquid and do not solidify in the heavy removals unit.

The third stream can include recyclable NGL separated from the heavies. At block 724, the recyclable NGL can be recycled to the first chiller. In at least one implementation, the recyclable NGL can include the original external NGL and NGLs produced by the natural gas stream during the cooling process. If necessary, the recyclable NGL may be purified, either by filtration and/or distillation, before it is recycled. In at least one implementation, additional fresh external NGL, (i.e., make up NGL) that is not recycled NGL, may be added to the recycled NGL, before entering the vessel and/or the first chiller. In an alternatively implementation, the fresh external NGL may be added directly to the vessel and/or the first chiller. In one implementation, about 5 $m^3$/hr to about 50 $m^3$/hr of NGL, about 10 $m^3$/hr to about 40 $m^3$/hr of NGL, or about 15 $m^3$/hr to about 30 $m^3$/hr of NGL can be recycled to the vessel.

When makeup external NGL solvent is added, enough is added to ensure sufficient liquids are formed when the external NGL and natural gas mixture is cooled, as described above. As little as a few liters to up to thousands of liters per hour can be added based at least in part on the efficiency of the heavies removal system. The size of the liquefaction plant and the amount of heavies to be removed can have an impact on the amount of external NGL solvent to be added. In some implementations, the external NGL solvent is precooled to a temperature below ambient temperature.

The operating conditions of the first and second stripping columns, such as temperature, pressure, stages of separation, feed locations and product locations can be adjusted to optimize external NGL recovery and to provide flexibility, when dealing with feedstock variability.

The processes disclosed herein may be performed in a continuous process or a batch process.

The processes and systems disclosed herein may further comprise one or more reboilers, wherein each boiler provides heating duty to the first stripping column, the second stripping column or both.

For example, disclosed herein is an LNG facility including one or more refrigeration cycles for successively cooling a fluid stream, each refrigeration cycle comprising: a refrigerant, a compressor, and a chiller; and a heavies removal system having a solvent recycle, wherein the heavies removal system comprises a vessel configured to receive a natural gas feed stream and a solvent; a first chiller for cooling the natural gas feed stream and the solvent to a temperature below about −30° C.; a first separator for separating a gas stream from a liquid stream; a second separator for separating the gas stream from an additional liquid stream; a second chiller positioned between the first separator and the second separator, the second chiller for reducing the temperature of the gas stream to below about −45° C.; a first stripping column for separating out the gas stream from the liquid stream and the additional liquid stream; a second stripping column for separating out a methane gas stream and a liquid bottoms, the second stripping column including a liquid recycle line connecting the second stripping column to the vessel for transferring a recycled solvent to the vessel, and a heavies removal line connected to the bottom of the second stripping column to remove heavies from the stripping column.

While the disclosure has been described in detail in connection with only a limited number of implementations, it should be readily understood that the disclosure is not limited to such disclosed implementations. Rather, the disclosure can be modified to incorporate any number of variations, alterations, substitutions or equivalent arrangements not heretofore described, but which are commensurate with the spirit and scope of the disclosure. Additionally, while various implementations of the disclosure have been described, it is to be understood that instances of the disclosure may include only some of the described implementations. Accordingly, the disclosure is not to be seen as limited by the foregoing description, but is only limited by the scope of the appended claims.

What is claimed is:

1. A process comprising:

combining a natural gas feed stream having a plurality of hydrocarbons including a quantity of heavies with a first natural gas liquid (NGL), in a first chiller to form a mixture, wherein the heavies include C6+ hydrocarbons;

cooling the mixture in the first chiller;

separating the mixture via a first separator to generate a liquid portion and a gas portion;

introducing the liquid portion and the gas portion into a first stripping column, wherein the gas portion is introduced towards a top of the first stripping column and the liquid portion is introduced below the gas portion;

removing a liquid bottoms from the first stripping column, wherein the liquid bottoms comprises the quantity of heavies dissolved therein;

introducing the liquid bottoms into a second stripping column and separating a second NGL from the quantity of heavies dissolved in the liquid bottoms; and recycling the second NGL to the first chiller as at least part of the first natural gas liquid.

2. The process in accordance with claim 1, wherein the natural gas feed stream further includes methane and nitrogen.

3. The process in accordance with claim 2, wherein the natural gas feed stream is a rich natural gas.

4. The process in accordance with claim 2, wherein the natural gas feed stream includes a lean natural gas.

5. The process in accordance with claim 2, wherein the natural gas feed stream includes a very lean natural gas.

6. The process in accordance with claim 1, wherein the first NGL comprises a $C_4$ and/or $C_5$ hydrocarbon.

7. The process in accordance with claim 1, wherein the first NGL comprises a $C_2$-$C_6$ alkane.

8. The process in accordance with claim 1, further comprising:

determining a composition of the natural gas feed stream including the quantity of heavies;

selecting an amount of the first NGL to combine with the natural gas feed stream that is sufficient to dissolve the quantity of heavies of the natural gas feed stream.

9. The process in accordance with claim 8, wherein from 100 $m^3/h$ to 450 $m^3/h$ of the first NGL is selected to be combined with the natural gas feed stream.

10. The process in accordance with claim 1, wherein the first chiller cools the mixture to a temperature at or below −30° C.

11. The process in accordance with claim 1, further comprising:

cooling the gas portion in a second chiller to a temperature at or below −45° C., to produce a reduced gas portion and a second liquid portion.

12. The process in accordance with claim 11, further comprising separating the second liquid portion from the reduced gas portion in a second separator.

13. The process in accordance with claim 12, further comprising combining the liquid portion from the first separator and the second liquid portion from the second separator prior to entering the first stripping column.

14. The process in accordance with claim 12, further comprising introducing the liquid portion from the first separator and the second liquid portion from the second separator at different locations within the first stripping column.

15. The process in accordance with claim 1, further comprising:

separating a first methane gas stream via the first stripping column;

separating a second methane gas stream from the liquid bottoms via the second stripping column; and transferring the first methane gas stream and the second methane gas stream to a liquefaction processing system.

16. A heavies removal system with solvent recycle comprising the following components, in combination:

a first chiller configured to receive and combine a natural gas feed stream and a first solvent into a mixture, the natural gas feed stream having a heavies content, wherein the heavies content includes C6+ hydrocarbons—the first chiller configured to cool the mixture to a temperature at or below −30° C.;

a first stripping column configured to receive a gas stream and a liquid stream separated from the mixture;

a second stripping column for separating out a methane gas stream from a liquid bottoms removed from the first stripping column, the liquid bottoms including a second solvent and a quantity of heavies, the second stripping column including a liquid recycle line connecting the second stripping column to the first chiller for transferring the second solvent to the first chiller as at least part of the first solvent, and a heavies removal line connected to the second stripping column to remove the quantity of heavies.

17. The heavies removal system with solvent recycle in accordance with claim 16, further comprising:

a first separator for separating the gas stream from the liquid stream;

a second chiller positioned between the first separator and the first stripping column, the second chiller for reducing the temperature of the gas stream to below −45° C., generating a reduced gas stream and a second liquid stream.

18. The heavies removal system with solvent recycle in accordance with claim 17, further comprising a second separator positioned between the second chiller and the first stripping column for separating the reduced gas stream from the second liquid stream, wherein liquid stream and the second liquid stream are combined in the first stripping column.

19. The heavies removal system with solvent recycle in accordance with claim 16, wherein the liquid recycle line is adapted to receive fresh solvent prior to coupling with the first chiller.

20. The heavies removal system with solvent recycle in accordance with claim 16, wherein the first solvent is an external natural gas liquid (NGL) comprising a $C_4$ and/or $C_5$ hydrocarbon.

21. The heavies removal system with solvent recycle in accordance with claim 16, wherein the first solvent is an external natural gas liquid (NGL) comprising a $C_2$-$C_6$ alkane.

* * * * *